United States Patent [19]

Banno et al.

[11] Patent Number: 4,710,771

[45] Date of Patent: Dec. 1, 1987

[54] COMPUTER IMAGE DISPLAY APPARATUS

[75] Inventors: Haruhiko Banno; Shigeo Yatagai, both of Tokyo, Japan

[73] Assignee: Kabushiki Kaisha Toshiba, Kawasaki, Japan

[21] Appl. No.: 620,485

[22] Filed: Jun. 14, 1984

[30] Foreign Application Priority Data

Jun. 22, 1983 [JP] Japan ..... 58-112162

[51] Int. Cl.[4] ..... G09G 1/14

[52] U.S. Cl. ..... 340/811; 340/720; 358/190

[58] Field of Search ..... 340/811, 814, 753, 720, 340/813; 358/190

[56] References Cited

U.S. PATENT DOCUMENTS

| | | | |
|---|---|---|---|
| 3,914,758 | 10/1975 | Ingle | 340/753 X |
| 4,012,592 | 3/1977 | Ricard | 340/814 X |
| 4,070,663 | 1/1978 | Kanatani et al. | 340/811 X |
| 4,075,621 | 2/1978 | Salmon | 340/811 X |
| 4,227,217 | 10/1980 | Balaban et al. | 340/814 X |
| 4,253,097 | 2/1981 | Hochstrate | 340/811 X |
| 4,271,409 | 6/1981 | Filliman | 340/811 X |
| 4,295,136 | 10/1981 | Stoutenburg | 340/753 |
| 4,295,138 | 10/1981 | Nakauchi et al. | 340/811 X |
| 4,331,978 | 5/1982 | Nowaczyk | 358/190 |
| 4,491,832 | 1/1985 | Tanaka | 340/814 X |
| 4,529,890 | 7/1985 | Kobayashi et al. | 340/811 X |

FOREIGN PATENT DOCUMENTS

| | | | |
|---|---|---|---|
| 58-46774 | 3/1983 | Japan | 358/190 |

OTHER PUBLICATIONS

I.B.M. Technical Reference, Computer Hardware Ref. Manual, First Edition (Revised Jan. 1983), 6936895, pp. 123–130.

*Primary Examiner*—Gerald L. Brigance

*Attorney, Agent, or Firm*—Cushman, Darby & Cushman

[57] ABSTRACT

In a personal computer wherein a digital circuit and an analog circuit commonly use the same power supply, a low-pass filter is inserted in a power supply line of an analog circuit to remove switching noise generated from the digital circuit or the power supply, thereby preventing the switching noise from being supplied to the analog circuit and hence output image and sound quality from being degraded due to interference by the switching noise in the analog circuit.

4 Claims, 7 Drawing Figures

FIG. 2 (PRIOR ART)
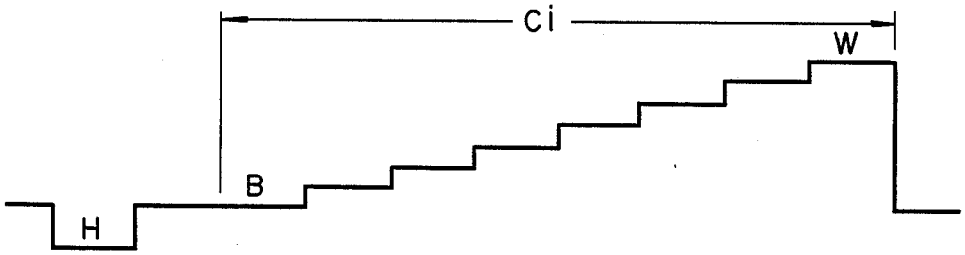
FIG. 3A (PRIOR ART)
FIG. 3B (PRIOR ART)
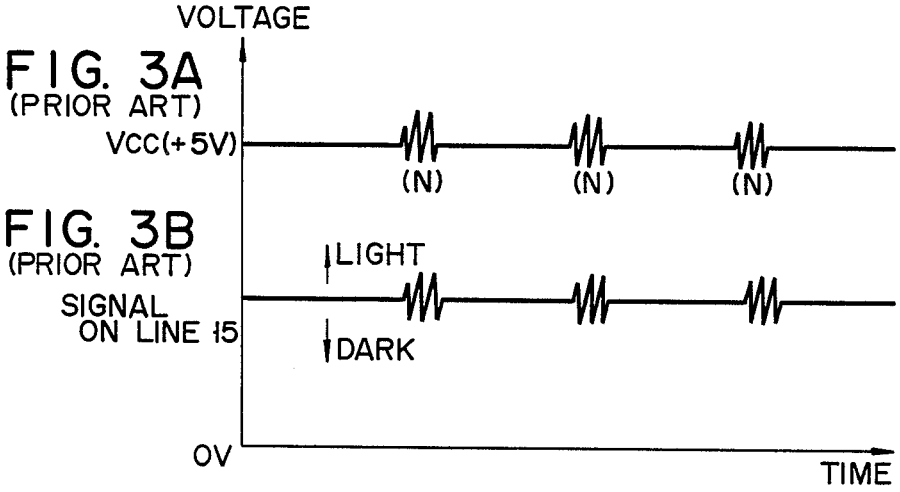
FIG. 5A
FIG. 5B
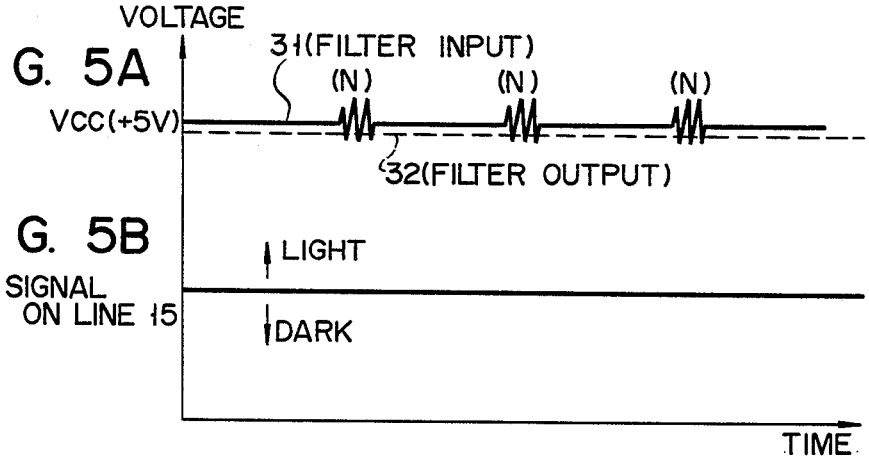

COMPUTER IMAGE DISPLAY APPARATUS

BACKGROUND OF THE INVENTION

The present invention relates to a computer display apparatus having a composite video interface driven by a power supply which drives a processor section.

A conventional image display apparatus of the type included in computer display apparatus has a composite video interface for handling video or audio analog signals and is driven by a power source which drives a processor section. In this image display apparatus, switching noise from the processor section, a switching regulator or the like is inserted in the composite video interface through a power supply line, so that jitter occurs in an output image or sound, thus degrading the output image or sound quality. FIG. 1 shows part of a conventional computer image display apparatus, and FIG. 2 shows a waveform of an output signal therefrom. Referring to FIG. 1, a video composite video interface (to be referred to as an interface for brevity hereinafter) serves as a circuit for generating a monochrome composite signal. This interface is connected to a central processing unit (CPU) 10, a key input section and a memory. Signal lines 11, 12 and 13 for transmitting a 3-bit signal representing 8-level gradation from a white level to a black level, and a signal line 14 for transmitting horizontal (H) and vertical (V) sync signals are connected to the processor section (CPU) 10. The signals on the signal lines 11, 12, 13 and 14 are supplied to an interface 20 which then generates a monochrome composite signal. The interface 20 has resistors R1 to R8, a driving transistor Q1 and monochrome composite signal output terminals 15 and 16. The monochrome composite signals are supplied to a CRT monitor 17 through the output terminals 15 and 16. A power supply 30 commonly supplies driving power (VCC, 5 V) to the CPU 10 and the interface 20 through a power supply line 31.

In this computer image display apparatus, the respective logic signals of TTL level supplied from the CPU 10 onto the signal lines 11, 12, 13 and 14 are combined by the resistors R1 through R6 of the interface 20 and are converted to an analog signal. This analog signal is applied to the base of the transistor Q1. Since the transistor Q1 constitutes an emitter follower, a voltage drop between the base and emitter thereof appears as an emitter output at the output terminals 15 and 16. The monochrome composite signals generated from the output terminals 15 and 16 comprise a signal Ci which is obtained as a combination of the bit signals on the signal lines 11, 12 and 13 and which represents a given luminance of the 8-level gradient varying from the white (W) level to the black (B) level, and horizontal and vertical sync signals (H and V), as shown in FIG. 2. This conventional composite video interface is described in "D-31: the IBM Personal Computer Technical Reference Manual" 6936895, First Edition, January 1983. Color gradation is described in "HOISTING THE COLOR STANDARD" by David H. Stvaayer, "COMPUTER DESIGN" July 1982, pp. 123–130.

When a switching noise component generated from the CPU 10 or a switching circuit of the power supply 30 runs on the VCC power supply line 31, as shown in FIG. 3A, this noise component passes through the resistor R5 and the transistor Q1 and appears at the output terminals 15 and 16. In this case, an output waveform is illustrated in FIG. 3B, wherein switching noise N runs on the VCC power supply line 31 when an intermediate-level signal appears at the output terminals 15 and 16. When the monochrome composite signal including this noise N is supplied to a CRT monitor 17, the noise N is visually displayed as interference in an image of an intermediate color. In general, the switching noise component generated from the CPU 10 and the power supply 30 has a high frequency and is continuously generated at a predetermined interval, so that stripe-like and flickering noise occur on the screen, thus degrading image quality. In particular, when the noise component has substantially the same frequency as that of the horizontal sync signal, beat noise occurs.

SUMMARY OF THE INVENTION

It is an object of the present invention to provide a computer image display apparatus having a video composite interface for video and audio analog signals, wherein switching noise generated at the time when the interface is operated by a power supply which simultaneously drives a processor section will not be applied to the interface, thereby generating stable, high-quality image and sound.

In order to achieve the above object of the present invention, in a computer image display apparatus having displaying means, compatible with a processing element for performing predetermined digital processing of data, for displaying digitally processed data, and an analog interface for interfacing said displaying means and said processing element, the improvement comprises filter means, inserted in a power supply line, for eliminating switching noise running on said power supply line.

BRIEF DESCRIPTION OF THE DRAWINGS

Other objects and features of the present invention will be apparent from the following description taken in connection with the accompanying drawings, in which:

FIG. 2 shows a waveform of a monochrome composite signal obtained by the apparatus shown in FIG. 1;

FIGS. 3A and 3B respectively show waveforms of output signals from a processor section (CPU) 10 shown in FIG. 1, in which FIG. 3A shows the waveform of the power supply voltage VCC, and FIG. 3B shows the waveform of the output signal from a video composite interface 20;

FIGS. 5A and 5B respectively show waveforms of output signals from a processor section (CPU) 10 shown in FIG. 4, in which FIG. 5A shows the waveform of the power supply voltage VCC, and FIG. 5B shows the waveform of the output signal from a video composite interface 20.

DETAILED DESCRIPTION OF THE PREFERRED EMBODIMENT

Figure 1:
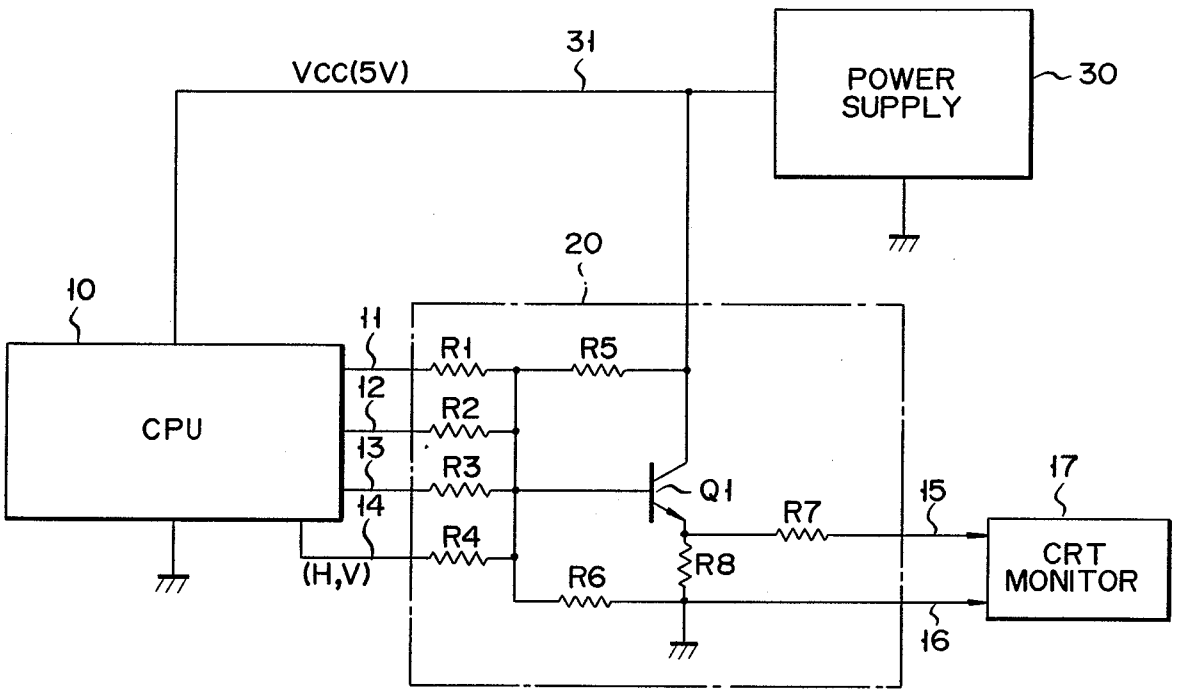
FIG. 1 (PRIOR ART)
FIG. 1 is a block diagram showing part of a conventional computer image display apparatus.
Figure 4:
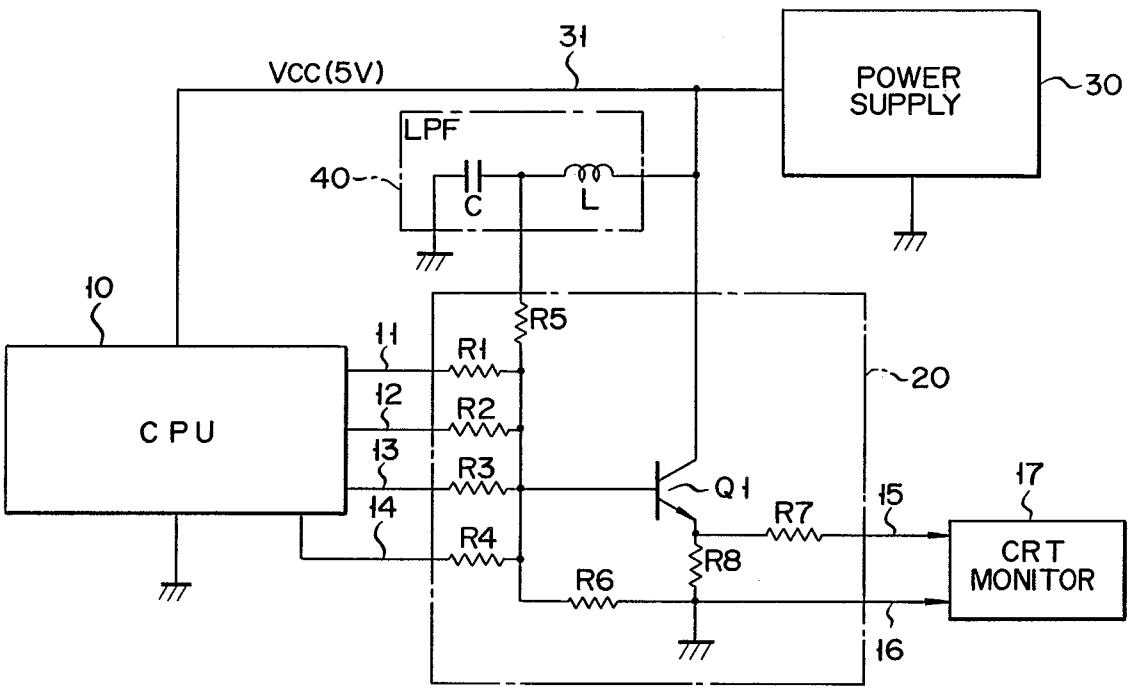
FIG. 4 is a block diagram showing part of a computer image display apparatus according to an embodiment of the present invention.

The same reference numerals used in an embodiment shown in FIG. 4 denote the same parts as in FIG. 1, and a detailed description thereof will thus be omitted. A switching noise removal low-pass filter (LPF) 40 consisting of an LC circuit is inserted between a resistor R5 of a video composite interface 20 (to be referred to as an interface for brevity hereinafter) and a VCC power supply line 31 of a power supply 30. A driving voltage (VCC, 5 V) from the power supply 30 is applied to the resistor R5 of the interface 20 through the LPF 40.

In the computer image display apparatus having the arrangement described above, the operating power supply voltage (VCC) generated from the power supply 30 is supplied to a CPU 10 and the interface 20. The driving voltage (VCC) applied to the interface 20 is supplied to the resistor R5 connected to the base of a transistor Q1 through the LPF 40. The respective signals (TTL level "1" or "0") on signals lines 11, 12, 13 and 14 are combined by resistors R1 through R6 and are converted to an analog signal which is then applied to the base of the transistor Q1. In this case, switching noise N generated from a digital circuit in the CPU 10 or from the power supply 30 runs on the VCC power supply line 31 connected to the power supply 30, as shown in FIG. 5A. However, the driving voltage (VCC) is applied to the resistor R5 in the interface 20 through the LPF 40. Therefore, a high-frequency switching noise component will not be superposed on the voltage signal applied to the base of the transistor Q1. An analog signal, which has a magnitude corresponding to a composite logic value of the bit data on the signal lines 11, 12, 13 and 14 and which is free from the switching noise, can thus be supplied to the base of the transistor Q1. Therefore, a monochrome composite signal which is free from switching noise appears at an output terminal OUT, as shown in FIG. 5B. Therefore, a clear image which is not disturbed by switching noise is displayed on the screen at a CRT monitor 17.

In the above embodiment, the monochrome composite signal generator is exemplified. However, the present invention is not limited to this arrangement but may be extended to analog circuits for handling analog audio signals, color analog signals, and the like. The CRT monitor 17 comprises a monochrome monitor with 8-level gradation. However, a color monitor with multiple level gradation can be used in place of the monochrome monitor.

What is claimed is:

1. A computer image display apparatus comprising:

processing means for performing predetermined digital processing of data;

displaying means, compatible with said processing means, for displaying data processed by said processing means;

a composite video interface for generating horizontal and vertical synchronizing signals;

power supply means for providing electric power to said processing means and said composite video interface;

a power supply line interconnecting said power supply means to said processing means and to said composite video interface for conducting said electrical power from said power supply means to said processing means and said composite video interface; and filter means, operatively disposed in said power supply line between said power supply means and said composite video interface, for eliminating switching noise in said electric power at approximately the same frequency as the frequency of said horizontal synchronizing signal, said electric power causing said composite video interface to be electrically energized, thereby preventing said switching noise from being displayed on said displaying means.

2. An apparatus according to claim 1, wherein:

said processing means outputs a plurality of digital signals representing level gradations from a white level to a black level and horizontal and vertical sync signals;

said composite video interface includes a plurality of resistors responsive to said plurality of digital signals and a driving transistor, said resistors being commonly connected to the base of said driving transistor;

said power supply means is connected to said base of said driving transistor via said power supply line; and said filter means is operatively disposed in said power supply line for eliminating the switching noise conducted from said power supply means to said driving transistor.

3. An apparatus according to claim 1, wherein said displaying means comprises monochrome displaying means with multilevel gradation.

4. An apparatus according to claim 1, wherein said displaying means comprises color displaying means with multilevel gradation.

* * * * *